US005730840A

United States Patent [19]

Hampl, Jr. et al.

[11] Patent Number: 5,730,840

[45] Date of Patent: Mar. 24, 1998

[54] CIGARETTE PAPER WITH IMPROVED ASH CHARACTERISTICS

[75] Inventors: Vladimir Hampl, Jr., Roswell; Larry D. Snow; Kerry A. Mahone, both of Alpharetta; David P. Pozzetta, Atlanta, all of Ga.

[73] Assignee: Schwietzer-Mauduit Inernational, Inc., Alpharetta, Ga.

[21] Appl. No.: 748,813

[22] Filed: Nov. 14, 1996

[51] Int. Cl.[6] ..... A24D 1/02

[52] U.S. Cl. ..... 162/139; 162/158; 131/365

[58] Field of Search ..... 162/139, 181.3, 162/158; 131/365, 331

[56] References Cited

U.S. PATENT DOCUMENTS

| | | | |
|---|---|---|---|
| 4,411,279 | 10/1983 | Martin et al. | 134/94 |
| 4,453,553 | 6/1984 | Cohn | 131/365 |
| 4,461,311 | 7/1984 | Mathews et al. | 131/365 |
| 4,480,644 | 11/1984 | Luke | 131/68 |
| 4,503,118 | 3/1985 | Murakami et al. | 428/323 |
| 4,548,677 | 10/1985 | Schneider et al. | 162/139 |
| 4,725,318 | 2/1988 | Minayoshi et al. | 106/465 |
| 4,732,748 | 3/1988 | Stewart et al. | 423/430 |
| 4,805,644 | 2/1989 | Hampl, Jr. et al. | 131/365 |
| 4,998,543 | 3/1991 | Goodman et al. | 131/365 |
| 5,060,675 | 10/1991 | Milford et al. | 131/365 |
| 5,074,321 | 12/1991 | Gentry et al. | 131/352 |
| 5,103,844 | 4/1992 | Hayden et al. | 131/365 |
| 5,107,866 | 4/1992 | Aronoff et al. | 131/365 |
| 5,109,876 | 5/1992 | Hayden et al. | 131/365 |
| 5,143,098 | 9/1992 | Rogers et al. | 131/365 |
| 5,152,304 | 10/1992 | Bokelman et al. | 131/365 |
| 5,156,719 | 10/1992 | Passaretti | 162/158 |
| 5,161,551 | 11/1992 | Sanders et al. | 131/365 |
| 5,168,884 | 12/1992 | Baldwin et al. | 131/365 |
| 5,172,708 | 12/1992 | Drewett et al. | 131/365 |
| 5,215,734 | 6/1993 | Kunesh et al. | 423/430 |
| 5,227,025 | 7/1993 | Kunesh et al. | 162/181.2 |
| 5,263,500 | 11/1993 | Baldwin et al. | 131/365 |
| 5,302,437 | 4/1994 | Idei et al. | 428/195 |
| 5,417,228 | 5/1995 | Baldwin et al. | 131/349 |
| 5,450,862 | 9/1995 | Baldwin et al. | 131/365 |
| 5,450,863 | 9/1995 | Collins et al. | 131/365 |

*Primary Examiner*—Donald E. Czaja
*Assistant Examiner*—Jose A. Fortuna
*Attorney, Agent, or Firm*—Dority & Manning, P.A.

[57] ABSTRACT

The present invention is directed to a method for improving the ash characteristics of a paper wrapper for a smoking article and for improving the ash characteristics of the smoking article itself. Specifically, it has been unexpectedly discovered that the ash characteristics of a paper wrapper are noticeably improved when a calcium carbonate filler having a median particle size of from about 0.15 microns to about 0.5 microns is incorporated into the paper. Paper wrappers made with the calcium carbonate particles of the present invention have superior ash characteristics in comparison to paper wrappers incorporating calcium carbonate particles of larger or smaller sizes. Further, the ash characteristics of the paper are improved without having to alter total filler levels in the paper.

22 Claims, No Drawings

CIGARETTE PAPER WITH IMPROVED ASH CHARACTERISTICS

FIELD OF THE INVENTION

The present invention is generally directed to a method for improving the ash characteristics of a paper used to construct smoking articles. More particularly, the present invention is directed to a process for improving the ash characteristics of a cigarette paper by adding to the paper a calcium carbonate filler having a particle size from about 0.15 microns to about 0.5 microns.

BACKGROUND OF THE INVENTION

Smoking articles such as cigarettes are conventionally made by wrapping a column of tobacco in a white wrapping paper. At one end, the smoking article usually includes a filter through which the article is smoked. Filters are attached to smoking articles using a tipping paper which is glued to the white wrapping paper. The wrapping papers and tipping papers used to construct smoking articles are typically made from flax or other cellulosic fibers and contain a filler, such as calcium carbonate.

Besides being used to hold the cigarette together, cigarette wrapping papers and tipping papers also contribute to and control many physical properties and characteristics of the cigarette. For instance, cigarette wrapping paper affects the rate at which the cigarette burns, the number of puffs per cigarette and the total tar delivery per puff. Another property of the cigarette that is affected by the wrapper is the appearance and characteristics of the ash that is formed as the cigarette burns. Ideally, cigarette ash should be cohesive, should not flake off from the cigarette, and should have an aesthetically pleasing appearance.

The quality of cigarette ash is generally determined by rating the ash according to four criteria. The first criteria is ash color. In general, a whiter ash has a more aesthetic appearance and is thus more desirable.

Another important characteristic of cigarette ash is its cohesiveness and its ability to avoid excessive flaking. The ash should not flake off the cigarette unless the cigarette is flicked or tapped on an object. Further, once the cigarette is tapped, the ash should break off in clumps and not disintegrate.

The last two criteria used to evaluate cigarette ash are dependant for the most part upon the cigarette wrapping paper and not upon the ash characteristics of the tobacco column. For example, cigarette ash is also evaluated by the thickness of the char line appearing on the wrapper as a cigarette is burned. Thinner char lines are preferred.

Finally, the last criteria is the extent to which the cigarette wrapper stains downstream (towards the filter) from the ash as the cigarette is smoked. A high quality wrapping paper will not stain or discolor throughout the length of the cigarette as the cigarette is puffed.

In the past, various methods have been devised in order to improve the ash characteristics of a smoking article. For instance, previous efforts for improving the appearance of ash have included changing the type of cellulosic fiber used to make the cigarette wrapping paper. Also, ash modifiers have been added to the paper or to the tobacco. In particular, it has been proposed in the past to add starches or salts to the paper. Unfortunately, ash modifiers may adversely effect the taste of the cigarette.

Thus, a need exists for a method of improving cigarette ash characteristics without affecting the other properties of the cigarette. In particular, a need exists for a method that improves the ash characteristics of a cigarette wrapping paper without adversely affecting the permeability of the paper, or the taste, the burn rate, the puff count, or the tar delivery per puff of a cigarette incorporating the paper.

SUMMARY OF THE INVENTION

The present invention recognizes and addresses various disadvantages of prior art constructions and methods.

In general, the present invention is directed to a method of improving the ash characteristics of a cigarette wrapping paper by incorporating into the paper a filler with a particle size in a narrowly defined range. In one preferred embodiment, the filler material is calcium carbonate having a median particle size of from about 0.15 microns to about 0.5 microns. Cigarette wrapping papers incorporating this filler unexpectedly provide a whiter ash and a more cohesive ash than wrapping papers made with a calcium carbonate filler of a larger or smaller size.

In the past, as disclosed in U.S. Pat. No. 5,161,551 to Sanders et al. which is incorporated herein by reference, a calcium carbonate filler was used in an attempt to improve the ash characteristics of a paper wrapper. Specifically, Sanders et al. discloses the use of calcium carbonate in cigarette wrapping paper having a median particle size of between about 0.02 microns and about 2 microns. Sanders et al. teaches that the ash characteristics of a paper can be improved by either decreasing the particle size of the filler or increasing the filler level in the paper. With respect to particle size, Sanders et al. teaches that cigarette ash is improved the most when the particle size of the calcium carbonate is at about 0.07 microns.

Contrary to Sanders et al., however, the inventors of the present invention have discovered that the ash characteristics of a wrapping paper are unexpectedly superior when incorporating into the paper calcium carbonate having a median particle size of between about 0.15 microns to about 0.5 microns, as opposed to 0.07 microns as is taught in the above reference. The inventors of the present invention have also discovered that ash characteristics are adversely effected if the particle size of the filler is increased or decreased from the above-described critical range. Such a finding is contrary to Sanders et al. which teaches that ash characteristics improve as particle size decreases.

Further, Sanders et al, teaches that the ash of a wrapping paper is improved if filler level is increased. Unfortunately, increasing the filler level can adversely effect the burn rate, the puff count, and tar delivery of the smoking article. Increasing the filler amount also decreases the strength of the paper, making the paper more likely to break when fed through high speed cigarette making machines. According to the present invention, on the other hand, the ash characteristics of the paper can be improved without having to change or alter the total filler level in the paper. In other words, according to the present invention, the ash characteristics of the paper are improved solely as a function of the particle size of the filler.

Accordingly, it is an object of the present invention to provide a method for improving the ash characteristics of a cigarette paper and of a cigarette incorporating the paper.

Another object of the present invention is to provide a method for improving the ash characteristics of a cigarette paper without having to increase filler levels.

It is another object of the present invention to provide a method for improving the ash characteristics of a cigarette paper by incorporating into the paper a calcium carbonate filler having a mean particle size within a narrowly defined range.

Still another object of the present invention is to provide a method for improving the ash characteristics of a cigarette paper by incorporating into the paper a calcium carbonate filler having a median particle size from about 0.15 microns to about 0.5 microns.

It is another object of the present invention to provide a method for improving the whiteness and cohesiveness of cigarette ash.

These and other objects of the present invention are achieved by providing a process for improving the ash characteristics of a paper wrapper for a smoking article. The process includes the step of incorporating into a paper wrapper a filler comprising calcium carbonate. The calcium carbonate has a median particle size of between about 0.15 microns to about 0.5 microns, particularly from about 0.2 microns to about 0.4 microns, and more particularly from about 0.25 microns to about 0.35 microns. The filler can be added to the paper wrapper in an amount from about 20% to about 40% by weight, and more particularly from about 25% to about 35% by weight.

According to the present invention, the paper wrapper can have a basis weight from about 18 gsm to about 60 gsm, but typically is from about 22 gsm to about 32 gsm. The paper wrapper can have a permeability from about 5 Coresta units to about 80 Coresta units.

In one embodiment, the paper wrapper can be coated with a burn control additive. The burn control additive, for instance, can be an alkali metal salt, an acetate, a phosphate salt, or mixtures thereof. For example, the burn control additive can be a citrate and can be added to the paper in an amount from about 0.3 percent to about 12% by weight.

The present invention is also directed to a process for improving the ash characteristics of a smoking article. The ash of the smoking article is improved by adding to a paper wrapper used to construct the smoking article a filler of calcium carbonate having a median particle size of from about 0.15 microns to about 0.5 microns. By incorporating the above calcium carbonate filler into a paper wrapper, the ash characteristics of the smoking article are unexpectedly whiter and more cohesive than an ash formed from a smoking article made with a paper wrapper containing a calcium carbonate filler having larger or smaller sized particles.

Other objects, features and aspects of the present invention are discussed in greater detail below.

DETAILED DESCRIPTION OF PREFERRED EMBODIMENTS

It is to be understood by one of ordinary skill in the art that the present discussion is a description of exemplary embodiments only and is not intended as limiting the broader aspects of the present invention which broader aspects are embodied in the exemplary construction.

The present invention is generally directed to a method for improving the ash characteristics of a wrapping paper and for improving the ash characteristics of a smoking article incorporating the wrapping paper. The ash characteristics are improved by adding to the paper a calcium carbonate filler having a mean particle size within a narrowly defined critical range. Specifically, the median particle size of the calcium carbonate should be between about 0.15 microns to about 0.5 microns, and more particularly between about 0.2 microns to about 0.4 microns. Further, the ash characteristics of the paper are improved without having to increase the amount of filler contained in the paper.

By incorporating into a paper wrapper a calcium carbonate filler having a mean particle size within the above-defined range, the ash characteristics of the paper are surprisingly and unexpectedly improved in comparison to papers containing fillers that have smaller or larger sized particles. This discovery is particularly unexpected in view of U.S. Pat. No. 5,161,551 to Sanders et al. which teaches that ash characteristics are optimized at a particle size of 0.07. Thus, Sanders et al. teaches away from the present invention and the improvements disclosed herein.

Paper wrappers for smoking articles made in accordance with the present invention exhibit a whiter ash when burned in comparison to paper wrappers containing smaller or larger sized calcium carbonate particles. Although unknown, the whiter appearance of the ash may be due in part to the fact that the particle size of the calcium carbonate filler used in the present invention corresponds approximately to one-half the wave length of visible light. Within this particle size range, it is believed that the calcium carbonate is more effective in scattering light, giving the ash a whiter appearance. Another unexpected benefit is that the ash is also more cohesive than many prior art constructions.

The construction of a cigarette wrapping paper made in accordance with the present invention will now be discussed in greater detail. Generally, the wrapping paper can be made from cellulosic fibers obtained, for instance, from flax, softwood or hardwood. In order to vary the properties of the paper as desired, various mixtures of cellulosic fibers can be used. The extent to which the fibers are refined can also be varied.

The total filler loading added to the paper wrapper can be between about 20% to about 40% by weight, and particularly between about 25% to about 35% by weight. The filler can be made completely from calcium carbonate particles or can be a mixture of different types of materials. In most applications, however, the filler should primarily be calcium carbonate having the desired particle size range. According to the present invention, the ash characteristics of the paper can be substantially and unexpectedly improved without having to increase or decrease total filler levels.

The permeability of a paper wrapper for smoking articles made according to the present invention can be generally from about 5 Coresta units to about 80 Coresta units. In most applications, the permeability should be between about 15 Coresta units to about 55 Coresta units.

The basis weight of cigarette wrapping paper is usually between about 18 gsm to about 60 gsm and more particularly between about 22 gsm to about 32 gsm. Wrapping papers according to the present invention can be made within any of these ranges. The cigarette paper may also be treated with a burn control additive. Such burn control additives can include, for instance, alkali metal salts, acetates, phosphate salts, or mixtures thereof. A particularly preferred burn control additive is a mixture of potassium citrate and sodium citrate. The burn control additive can be added to the paper in an amount from about 0.3% to about 12% by weight, and more particularly between about 0.3% to about 3% by weight.

As described above, the present invention is directed to incorporating into a paper wrapper a calcium carbonate filler that improves the ash characteristics of the paper and of a smoking article constructed with the paper. As stated above, the calcium carbonate filler should have a median particle size of from about 0.15 microns to about 0.5 microns, and more particularly from about 0.2 microns to about 0.4 microns. As used herein, the particle size of the filler is measured and determined by a sedimentation procedure using, for instance, a Sedigraph.

In one embodiment, the calcium carbonate filler can be combined with water to form a filler slurry. The slurry can then be added to a suspension of cellulosic fibers when forming the paper. For instance, the fiber suspension can be formed from a fiber furnish that has been cooked in a digester, washed, bleached and refined. To form the paper wrapper, the resulting slurry and fiber suspension mixture can be spread out onto a screen or a set of screens and dried.

Besides being added to a fiber suspension when the paper is formed, it is also believed that the calcium carbonate filler can be coated onto the paper after it has been formed.

One particular commercially available calcium carbonate filler that can be used in the present invention is ULTRAPAQUE marketed by Specialty Minerals, Inc. of Adams, Mass. ULTRAPAQUE contains rhombohedral precipitated calcium carbonate particles having a median size of about 0.3 microns. The calcium carbonate particles have a surface area of approximately 7.5 $m^2/g$.

The present invention may be better understood with reference to the following examples.

EXAMPLE NO. 1

The ash characteristics of a paper wrapper incorporating ALBACAR 5970 calcium carbonate filler having a median particle size of 1.9 microns was compared with the ash characteristics of a paper incorporating ULTRAPAQUE calcium carbonate filler having a median particle size of about 0.3 microns. Both the ALBACAR 5970 filler and ULTRAPAQUE filler were obtained from Speciality Minerals, Inc. of Adams, Mass.

Cigarette wrappers were made incorporating the following mixtures of ALBACAR 5970 filler and ULTRAPAQUE filler:

TABLE I

Filler Mixtures Used to Construct Paper Wrappers

| | Filler Ratio (%) | |
|---|---|---|
| Sample No. | ALBACAR 5970 (1.9 microns) | ULTRAPAQUE (0.3 microns) |
| 1 | 100 | 0 |
| 2 | 79 | 21 |
| 3 | 57 | 43 |
| 4 | 33 | 67 |
| 5 | 14 | 86 |

All of the sample wrappers had a basis weight of 25 gsm and a total filler loading of 28% by weight. Each sample also contained 0.6% by weight citrate.

Cigarettes were then made using a laboratory cigarette maker using the above-described paper wrappers. Each of the cigarettes were lit and allowed to free burn in a static mode. As the cigarette burned, the ash was observed and evaluated. Pictures were also taken of the ash as it formed.

From this experiment, it was discovered that as the amount of ULTRAPAQUE in the paper increased, the ash became noticeably whiter and somewhat more cohesive.

EXAMPLE NO. 2

Handsheets representing cigarette wrapping paper were also made incorporating ULTRAPAQUE calcium carbonate filler having a median particle size of about 0.3 microns in one set and incorporating MULTIFEX calcium carbonate filler having a median particle size of about 0.07 microns in another set. The MULTIFEX filler was obtained from Specialty Minerals, Inc. of Adams, Mass. All of the handsheets had a filler loading level of about 30% by weight and had a basis weight of about 27 gsm.

Cigarettes were hand rolled from the hand sheets. The cigarettes were lit and allowed to burn freely. As the cigarette burned, the formed ash was observed and evaluated.

From this example, it was discovered that the ash formed from the cigarette wrapped in the paper incorporating the ULTRAPAQUE filler was noticeably and unexpectedly whiter in comparison to the ash created by the cigarette containing the paper incorporating the MULTIFEX filler. The cigarette ash containing the ULTRAPAQUE filler was also somewhat more cohesive than the cigarette ash containing the MULTIFEX filler.

These and other modifications and variations of the present invention may be practiced by those of ordinary skill in the art, without departing from the spirit and scope of the present invention, which is more particularly set forth in the appended claims. In addition, it should be understood that aspects of various embodiments may be interchanged both in whole or in part. Furthermore, those of ordinary skill in the art will appreciate that the foregoing description is by way of example only, and is not intended to limit the description so further described in such appended claims.

What is claimed is:

1. A process for improving the ash characteristics of a paper wrapper for a smoking article comprising the step of:

incorporating into a paper wrapper a filler comprising calcium carbonate, said calcium carbonate having a median particle size of between about 0.15 microns to about 0.5 microns; and coating said paper wrapper with a burn control additive.

2. A process as defined in claim 1, wherein said calcium carbonate has a median particle size of between about 0.2 microns to about 0.4 microns.

3. A process as defined in claim 1, wherein said calcium carbonate has a median particle size between about 0.25 microns to about 0.35 microns.

4. A process as defined in claim 1, wherein said filler is added to said paper wrapper in an amount from about 20% to about 40% by weight.

5. A process as defined in claim 1, wherein said paper wrapper has a basis weight from about 18 gsm to about 60 gsm.

6. A process as defined in claim 1, wherein said paper wrapper has a permeability from about 5 Coresta units to about 80 Coresta units.

7. A process as defined in claim 1, wherein said burn control additive is a material selected from the group consisting of alkali metal salts, acetates, phosphate salts, and mixtures thereof.

8. A process as defined in claim 1, wherein said burn control additive comprises a citrate, said citrate being added to said paper wrapper in an amount from about 0.3% to about 12% by weight.

9. A process for improving the ash characteristics of a paper wrapper for a smoking article, said paper wrapper having a basis weight from about 18 gsm to about 60 gsm, said process comprising the step of:

adding to said paper wrapper a filler consisting essentially of calcium carbonate, said calcium carbonate having a median particle size of between about 0.15 microns to about 0.5 microns, said filler being added to said paper wrapper in an amount from about 20% to about 40% by weight; and adding to said paper wrapper a burn control additive.

10. A process as defined in claim 9, wherein said calcium carbonate has a median particle size of between about 0.2 microns to about 0.4 microns.

11. A process as defined in claim 9, wherein said filler is added to said paper wrapper in an amount from about 25% to about 35% by weight.

12. A process as defined in claim 9, wherein said paper wrapper has a basis weight of between about 22 gsm to about 32 gsm.

13. A process as defined in claim 9, wherein said paper wrapper has a permeability of from about 5 Coresta units to about 80 Coresta units.

14. A process as defined in claim 9, wherein said paper wrapper has a permeability of from about 15 Coresta units to about 55 Coresta units.

15. A process as defined in claim 9, wherein said burn control additive comprises a citrate.

16. A process as defined in claim 15, wherein said citrate is added to said paper wrapper in an amount from about 0.3% to about 3% by weight.

17. A process for improving the ash characteristics of a smoking article comprising the step of:

adding to a paper wrapper incorporated into said smoking article a filler comprising calcium carbonate, said calcium carbonate having a median particle size of from about 0.15 microns to about 0.5 microns, said filler being added to said paper wrapper in an amount from about 20% to about 40% by weight, said paper wrapper having a basis weight from about 18 gsm to about 60 gsm and having a permeability from about 15 Coresta units to about 55 Coresta units, said paper wrapper being coated with a citrate.

18. A process as defined in claim 17, wherein said calcium carbonate has a median particle size of between about 0.25 to about 0.35 microns.

19. A process as defined in claim 17, wherein said filler is present in said paper wrapper in an amount from about 25% to about 35% by weight.

20. A process for improving the ash characteristics of a paper wrapper for a smoking article comprising the step of:

incorporating into a paper wrapper a filler comprising calcium carbonate, said calcium carbonate having a median particle size of between about 0.15 microns to about 0.5 microns and a burn control additive, said paper wrapper having a permeability of from about 5 CORESTA units to about 80 CORESTA units.

21. A process as defined in claim 20, wherein said filler is added to said paper wrapper in an amount from about 20% to about 40% by weight.

22. A process as defined in claim 21, wherein said calcium carbonate has a median particle size of between about 0.2 microns to about 0.4 microns.

* * * * *